US008015738B2

(12) United States Patent
Ernetoft

(10) Patent No.: US 8,015,738 B2
(45) Date of Patent: Sep. 13, 2011

(54) DISPLAY STAND

(75) Inventor: Ulf Ernetoft, Mississauga (CA)

(73) Assignee: Accenta Display Corp., Mississauga, ON (CA)

( * ) Notice: Subject to any disclaimer, the term of this patent is extended or adjusted under 35 U.S.C. 154(b) by 49 days.

(21) Appl. No.: 12/453,901

(22) Filed: May 27, 2009

(65) Prior Publication Data

US 2010/0199537 A1 Aug. 12, 2010

(30) Foreign Application Priority Data

May 28, 2008 (CA) ..... 2632388
Nov. 4, 2008 (CA) ..... 2642881

(51) Int. Cl.
*G09F 15/00* (2006.01)

(52) U.S. Cl. ..... 40/607.1; 40/610

(58) Field of Classification Search ..... 40/610, 40/606.12, 607.1, 607.11, 607.03, 606.16, 40/611.05
See application file for complete search history.

(56) References Cited

U.S. PATENT DOCUMENTS 3,699,699 A * 10/1972 Bramble ..... 40/609
4,071,969 A * 2/1978 Tonhauser ..... 40/610
4,642,946 A * 2/1987 Koch ..... 52/38
5,664,749 A 9/1997 Kump et al.
5,787,621 A * 8/1998 Leksell ..... 40/607.03
5,966,857 A 10/1999 Pettersson et al.
6,105,292 A 8/2000 Current
7,134,230 B1 * 11/2006 Boens et al. ..... 40/610

FOREIGN PATENT DOCUMENTS

WO WO 2007/040432 4/2007
WO WO 2008/012568 A1 1/2008

* cited by examiner

*Primary Examiner* — Joanne Silbermann
*Assistant Examiner* — Kristina Staley

(57) ABSTRACT

The advertising display stand includes a planar base with two opposed mounting brackets secured on an upper surface of the base. A collapsible support post of a rectangular configuration is secured atop the base due to engagement with the brackets. The collapsible support post in a non-collapsed state includes opposed slots that receive and engage upwardly extending portions of the mounting brackets. An advertising media is provided on or supported by the support post. In one embodiment the support post is formed from stacked elements of a known segmented wall advertising system.

13 Claims, 15 Drawing Sheets

DISPLAY STAND

FIELD OF THE INVENTION

The invention relates to advertising displays, and in particular to self-supporting advertising displays of the column type that are collapsible to a flat configuration.

BACKGROUND OF THE INVENTION

There are a number of different advertising displays, and a number of these are collapsible displays specifically designed for easy shipping or transportation. In particular, these collapsible displays have a number of different cooperating segments and collapse to typically be transported in a lightweight container. With these structures, the user is able to easily carry the advertising display and quickly assemble the display at a desired site. Many of these advertising display stands are made of a laminated cardboard material or other lightweight printable material having a high quality printed advertisement provided on the exterior surface of the display stand.

U.S. Pat. No. 5,966,857 discloses a display stand which is easy to assemble and may be used as a free standing display or as a hanging display. The display uses an upper sub-assembly that is connected to a lower sub-assembly, and two foot assemblies are provided at the base of the unit to allow the display stand to be self supporting. The outer surface of the display stand has bowed side walls or curved side walls which join at two opposed corner regions. Each of the sub-assemblies include reinforcing members interior to the outer walls of the display stand for maintaining the bowed configuration of the advertising walls. Unfortunately, with this advertising display stand, the overall stability of the unit is not as high as would be desired, and the individual feet members 24 are subject to inadvertent abuse and/or breakage by a person who may be walking by the display stand.

A different type of display tower is disclosed in PCT application WO 2007/040432. In this reference the assembly includes an inner post that includes outwardly extending flanges at the bottom of the post to extend below and be held in place by a base portion. The base portion includes a large central recess sized to allow the securing post to pass through the base portion. An outer sleeve can then be placed about the support post and provides a final display surface. The stability of this structure relies on the weight of the base portion holding the flanges of the inner post against a support surface. However, the display system is quite specialized in that the base portion must be provided with a recess for receiving the post and the post must include bottom flanges that extend beneath the base portion. Depending upon the particular surface that the device is supported on, the stability of the advertising display can be adversely affected.

The present invention provides an advertising display system that is cost effective to manufacture and provides good stability. Furthermore, in a preferred embodiment, the advertising display can advantageously use components from other advertising displays in providing a preferred form of the interior support post.

SUMMARY OF THE INVENTION

An advertising display according to the present invention comprises a generally planar base with two opposed mounting brackets securable on an upper surface of the base. A collapsible support post, that is generally rectangular in configuration in cross-section, is secured atop the base. The collapsible support post in a non-collapsed condition includes opposed slots that receive and engage upwardly extending portions of the mounting brackets provided on the upper surface of the base. These mounting brackets connect the support post to the upper surface of the base. An advertising media is provided on or supported by the support post.

According to an aspect of the invention, the advertising media is a deformable flat sleeve sized to be applied over the support post and deform to a bowed side-walled configuration in engagement with and supported by the support post. The support post and the flat sleeve cooperate such that the sleeve engages the support post in a manner to maintain the bowed side walls while the sleeve is in engagement with the support post.

In a further aspect of the invention, the flat sleeve is biased to maintain a flat configuration, and when applied over the support post, moves to the bowed configuration in engagement with the support post.

In a further aspect of the invention, at least two rectangular-in-section elongate collapsible support members are stacked one above the other with connectors extending therebetween to maintain the collapsible support members in the stacked configuration. These support members form the support post.

In a further aspect of the invention, the support members are additionally designed as a component of an advertising display system for forming a segmented wall advertising display. With this arrangement, a purchaser of a segmented wall advertising display can then utilize certain components of the segmented wall advertising display for forming the support post of the present advertising display.

In a preferred aspect of the invention, each support bracket includes a securing flange fixed to the base and a pivotal portion moveable from a collapsed position generally parallel to the base to a support post engaging position extending outwardly away from the base.

In a further aspect of the invention, each pivotal portion of each mounting bracket extends to a support post engaging position generally perpendicular to the base.

In a yet further aspect of the invention, each mounting bracket is made of a plastic material with an integral hinge portion intermediate the length of the mounting bracket.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
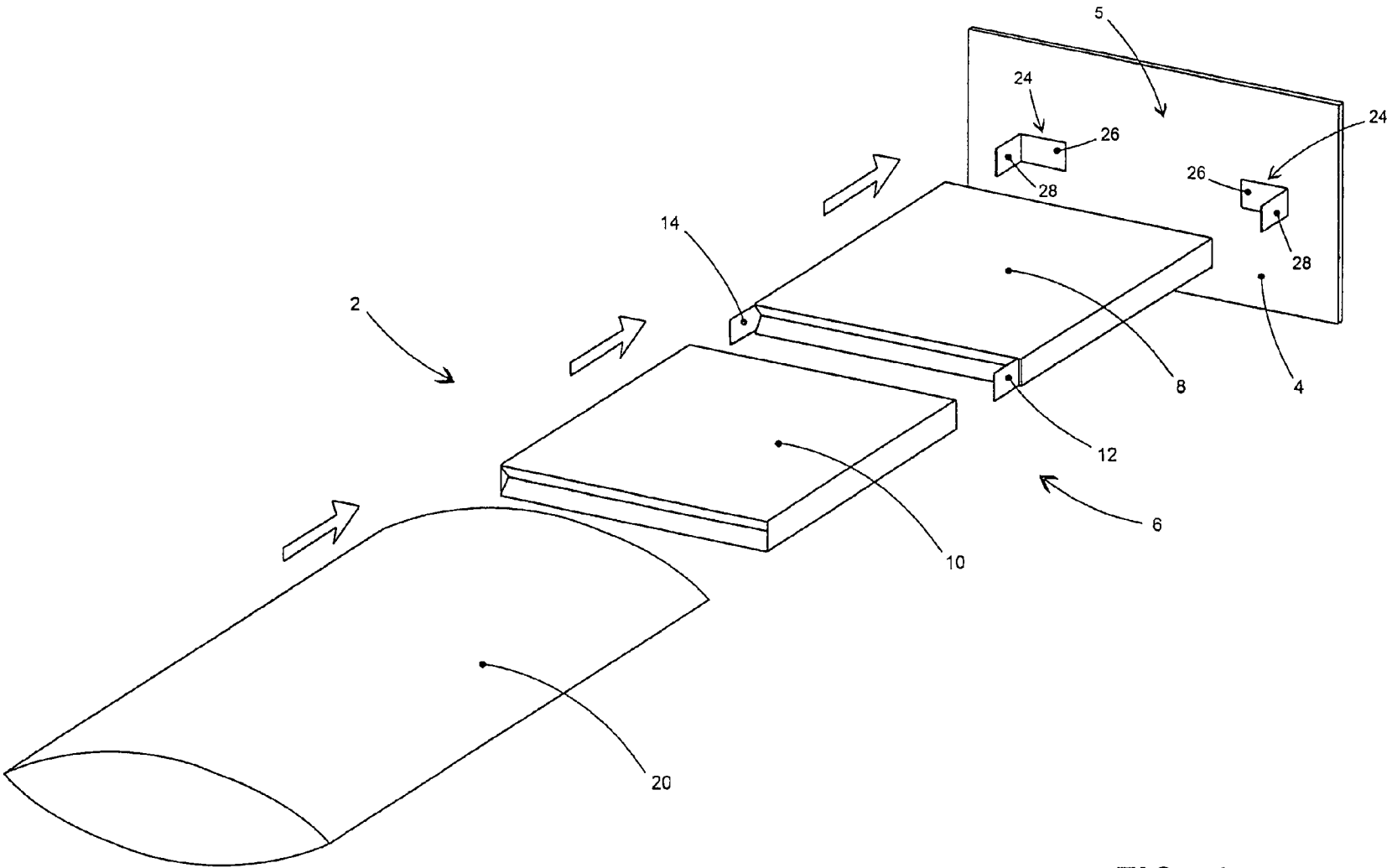
FIG. 1 is an exploded perspective view of the advertising display and the various components thereof.

The advertising display 2 includes a planar base 4 having a pair of mounting brackets 24 provided on an upper surface 5 of the base. These mounting brackets include a base portion 26 secured to the planar base 4 and a hinged portion 28 moveable to a perpendicular orientation relative to the base as shown in FIG. 1. The perpendicularly extending hinge portions are received in the collapsible support post 6 defined by the stacked collapsible support members 8 and 10.

Collapsible support members 8 and 10 are of a generally rectangular cross-section and preferably are components of a segmented wall advertising system that can be defined by stacking of these support members one above the other. In the present system the mounting brackets 24 and in particular the hinged portions 28, are of a design to be received in an end slot of the collapsible support members 8 or 10 and provide a secure engagement of the collapsible support members to the planar base.

Each of the collapsible support members 8 and 10 receive a portion of the bayonet-type connectors 12 and 14 that are received in end slots of these members. The bayonet connectors 12 and 14 are shown in a fully inserted position with respect to the collapsible support member 8 and are aligned for insertion in end slots of the collapsible support member 10.

In the preferred embodiment shown in FIG. 1, the collapsible support post 8 is defined by the stacked collapsible support members 10 which are secured to the planar base 4. A deformable flat sleeve 20 is designed to slide over the collapsible support members 8 and 10 and maintain a bowed-wall configuration as generally shown in FIGS. 1 and 11.

Figure 11:
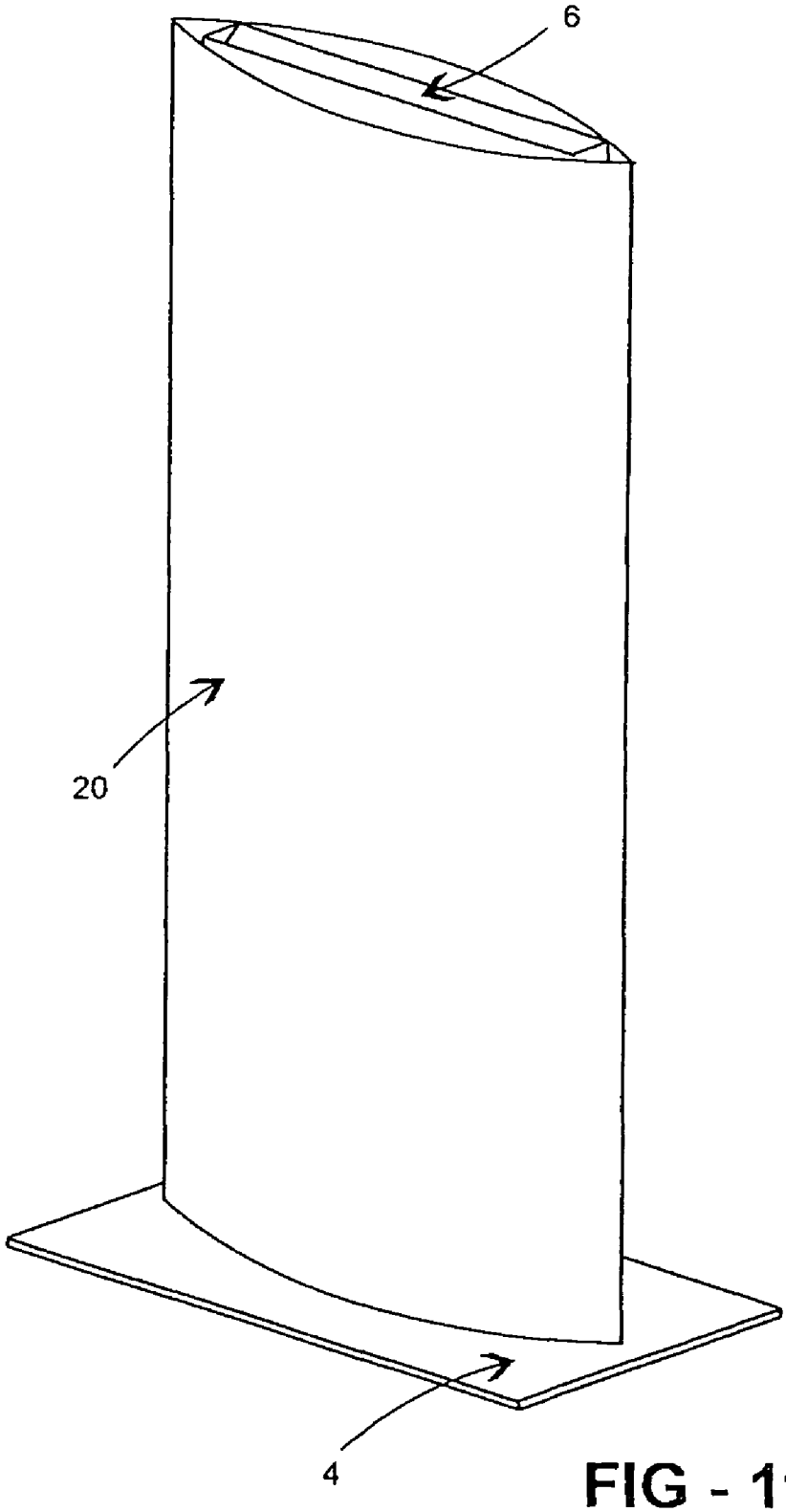
Figure 12:
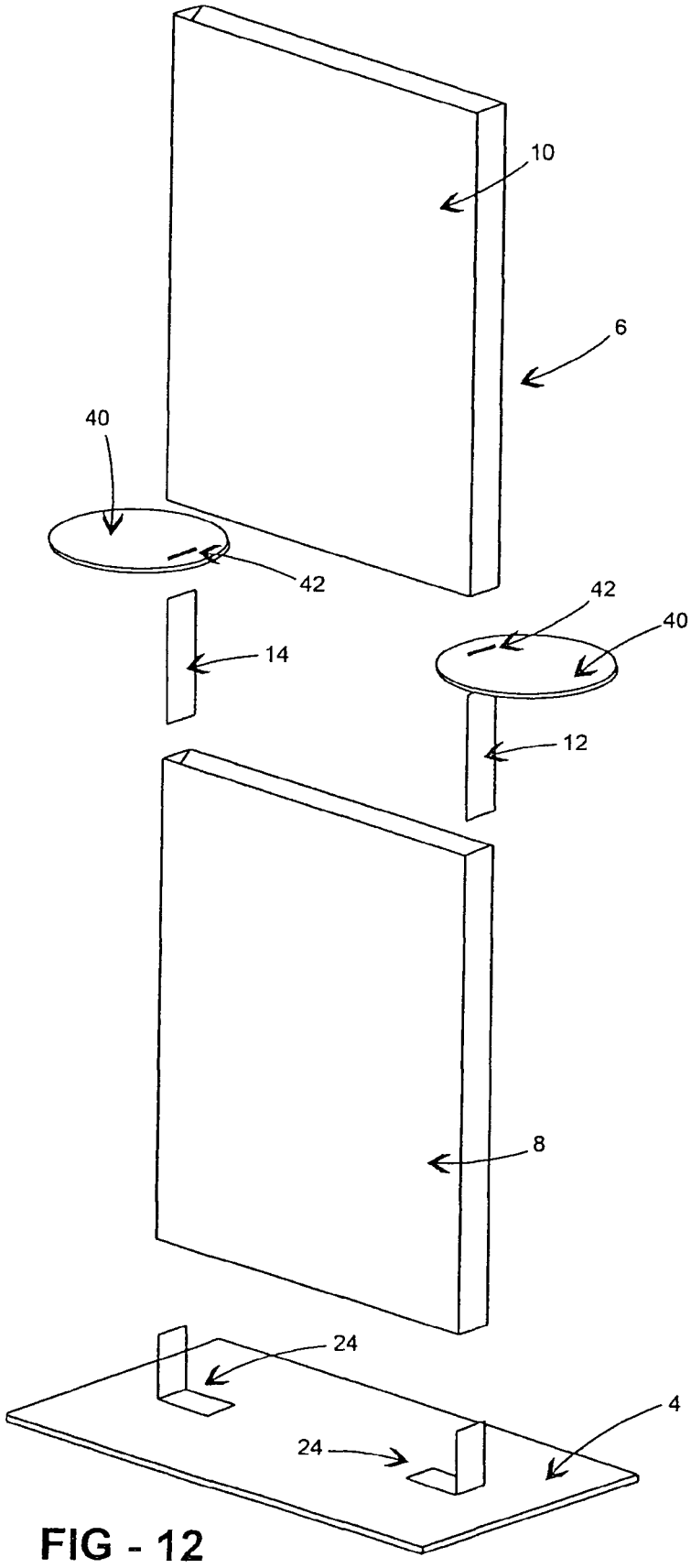
FIGS. 12 through 15 show further embodiments of the system where the advertising display utilizes the support post and includes horizontally extending shelf surfaces either side of the support post.
Figure 13:
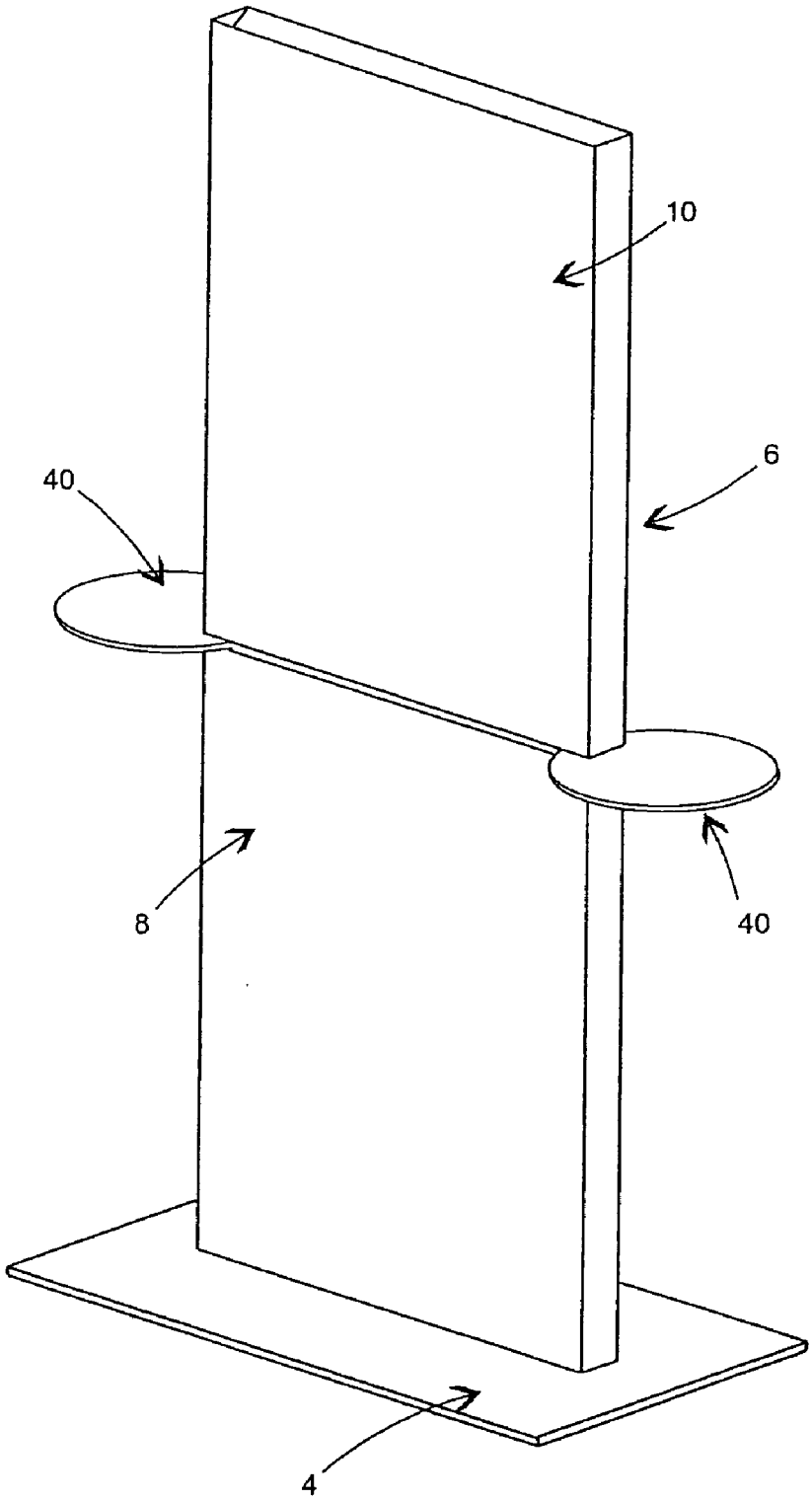
Figure 14:
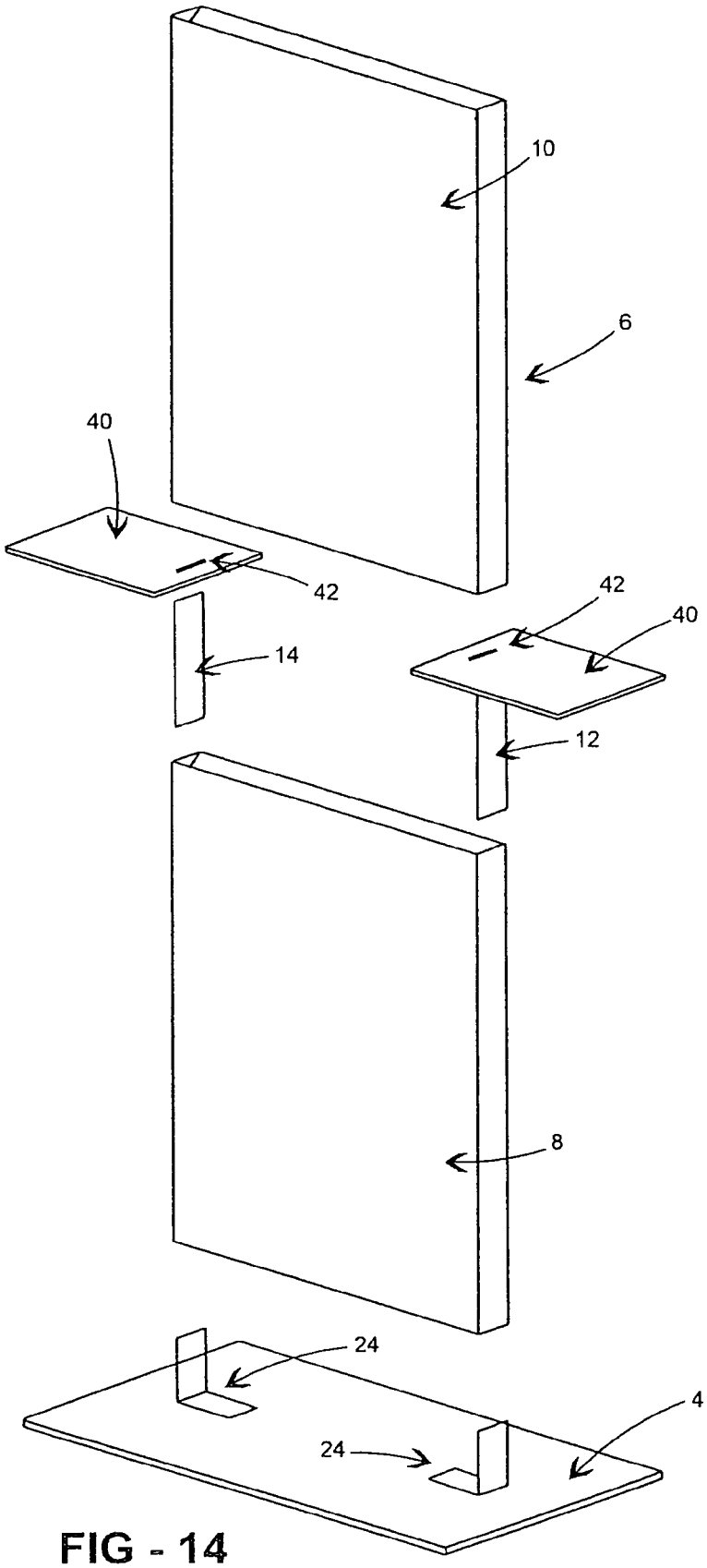
Figure 15:
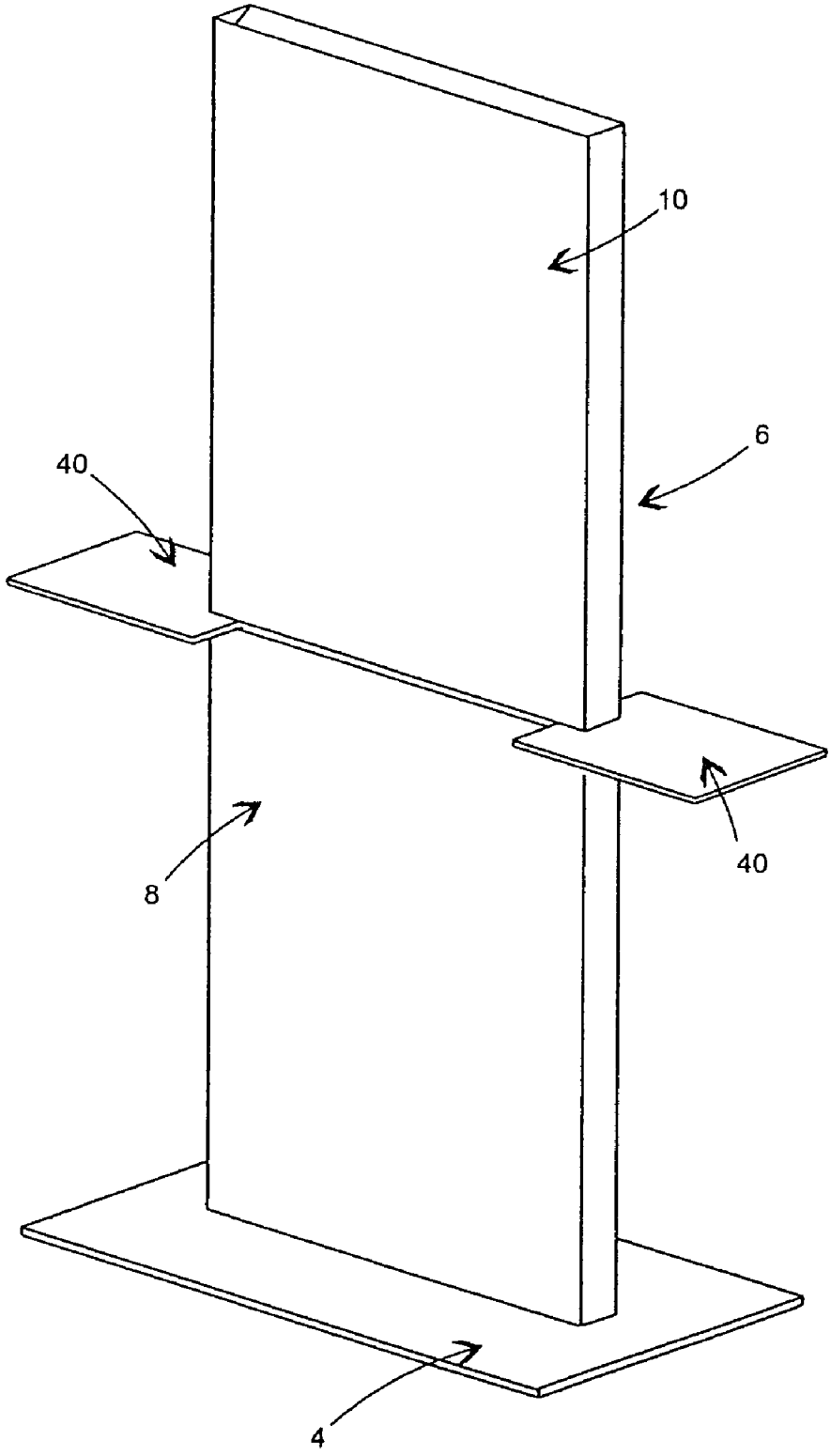
Figure 16:
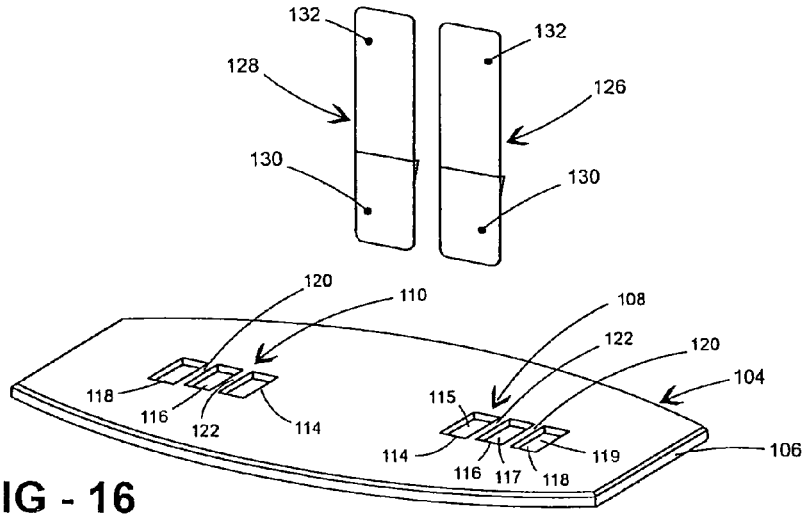
FIGS. 16, 17 and 18 show details of an alternate base portion for the advertising display.

As seen in FIG. 11, the deformable flat sleeve 20, when inserted on the support post 6, is in engagement with the support post at generally the corners of the support post and thus the support post maintains the sleeve 20 in the desired bowed configuration. It is preferred that the flat sleeve 20 have an inherent bias urging the flat sleeve to the flat configuration. This bias will maintain the sleeve in engagement with the support post and provides a simple arrangement for assembling of the advertising display. Other arrangements for maintaining the advertising sleeve can also be used. For example the sleeve could be biased to a bowed wall configuration of a size for close abutment with the support post.

Figure 2:
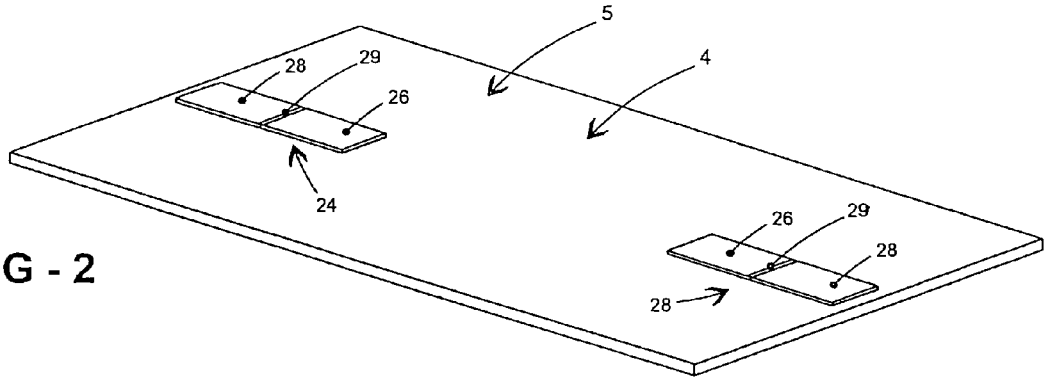
FIGS. 2 through 4 are perspective views of the base of the advertising display and the mounting brackets in different configurations for receiving of the support post.
Figure 3:
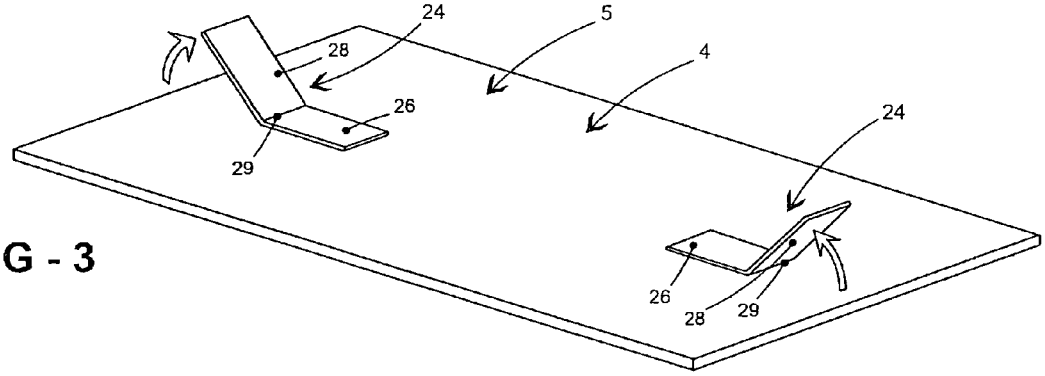
Figure 4:
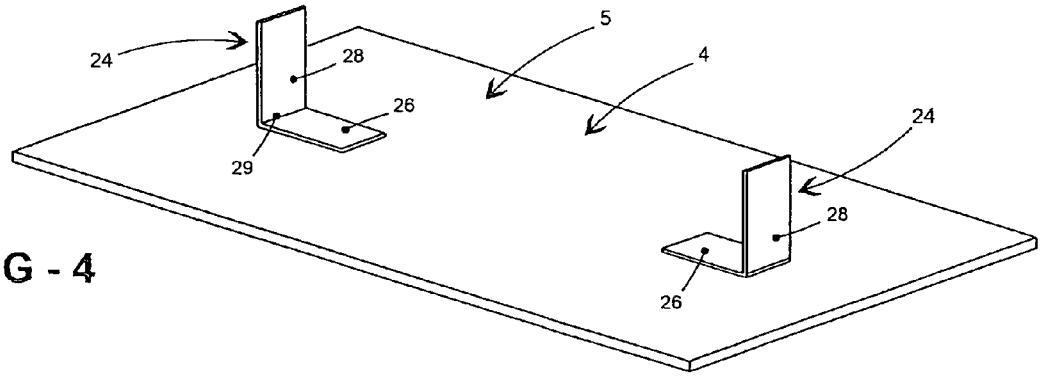

One of the main advantages with the advertising display shown in the drawings is associated with the base 4 and the mounting brackets 24 which are secured on the upper surface 5 of the base. Each of the mounting brackets preferably has a base portion 26 secured to the base by means of a mechanical fastening arrangement such as staples, screws etc. or it can be adhesively secured to the base. Preferably, the mounting brackets are designed to assume the generally horizontal orientation shown in FIG. 2 and are moveable as shown in FIGS. 3 and 4 to the perpendicular orientation of the hinged portions 28 for engaging the collapsible support post 6. The base 4 is preferably made of an engineered wood product such as particle board, and it can include a laminated upper surface to provide a better finished surface. The mounting brackets 24 are designed to be essentially concealed by the support post when the support post is mounted to the base.

Figure 5:
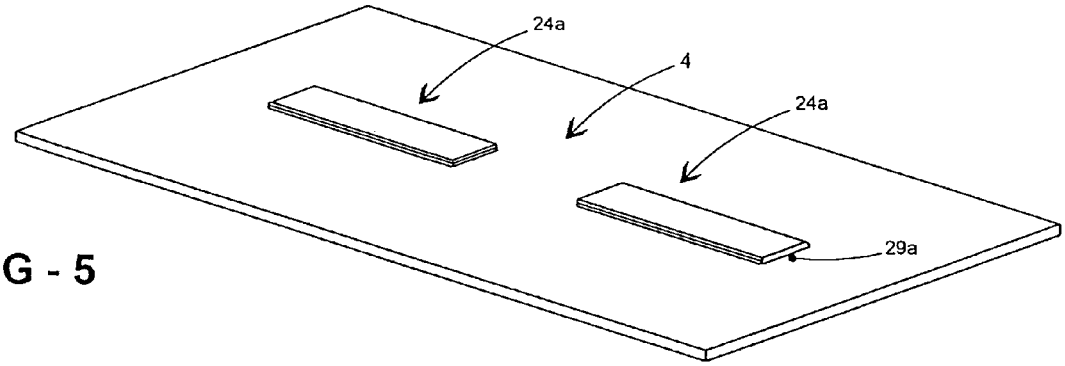
FIGS. 5 through 7 are perspective views of an alternate embodiment of the base where the mounting brackets are hinged, and in the collapsed state the hinged portion overlies the base portion of the mounting bracket.
Figure 6:
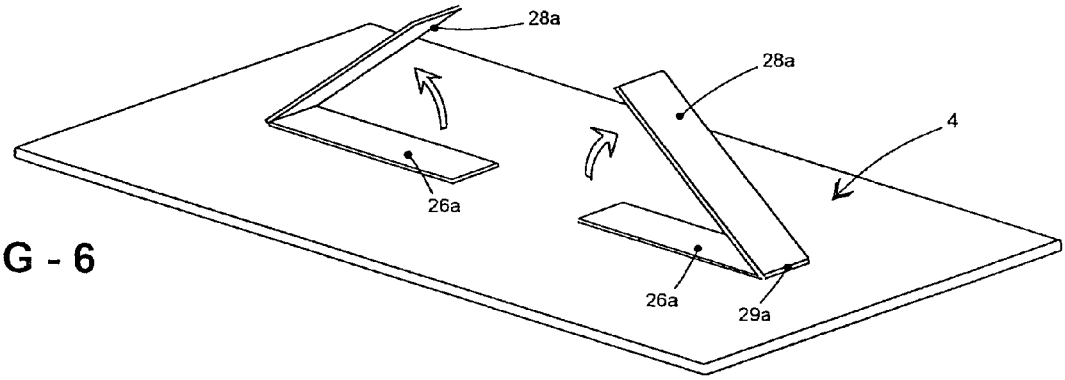
Figure 7:
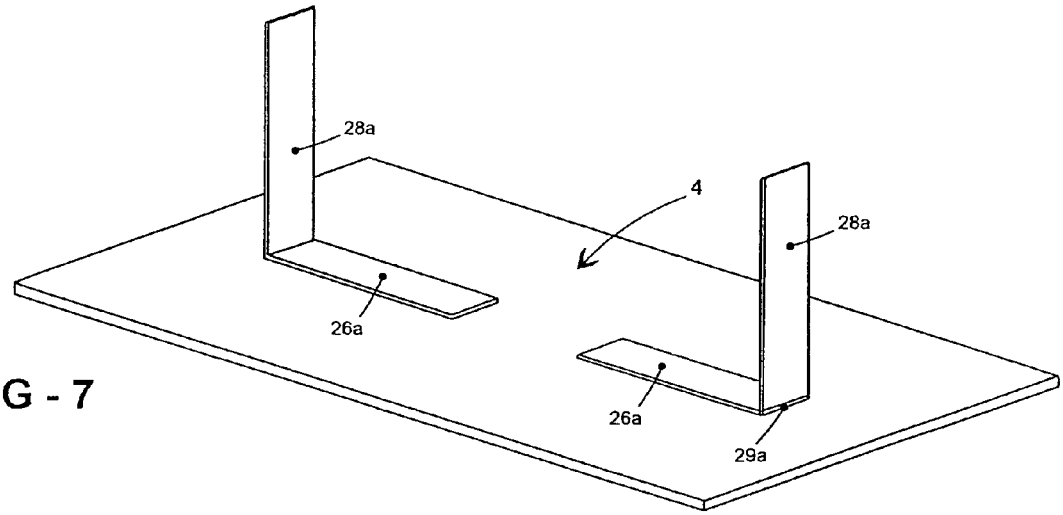

FIGS. 5 through 7 show a variation of the mounting bracket which has now been labeled 24*a*. In this embodiment, the mounting bracket has the base portion 26 and the hinged portion 28 overlying one another in the horizontal orientation. The hinged portion 28*a* is then pivoted outwardly to the position of FIG. 7 for engagement with the support posts. This structure allows the hinged portion 28 to be of increased length for further receipt in the collapsible support post 6.

Figure 8:
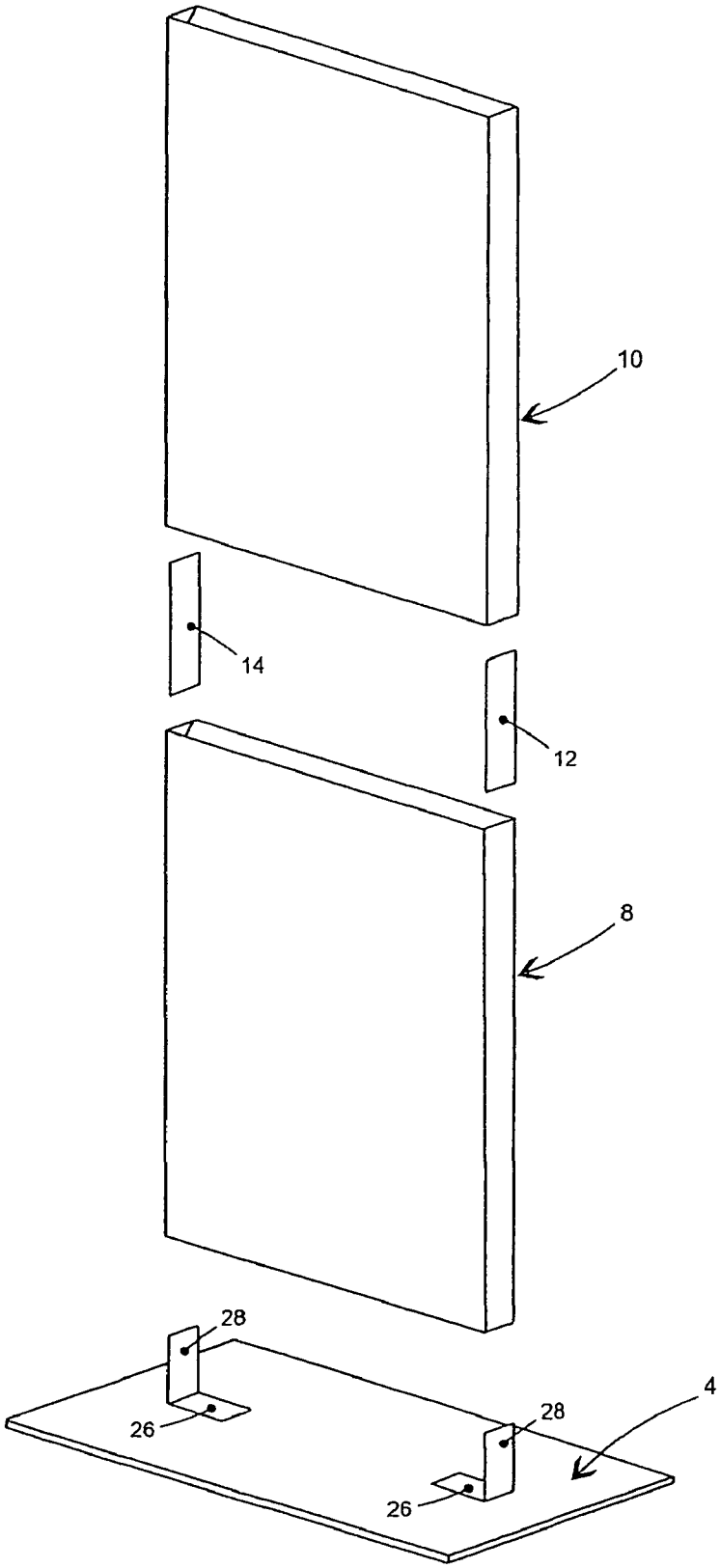
FIGS. 8 and 9 are perspective views of the advertising display system and FIG. 9 shows the advertising display system utilizing only the base and the support post.
Figure 9:
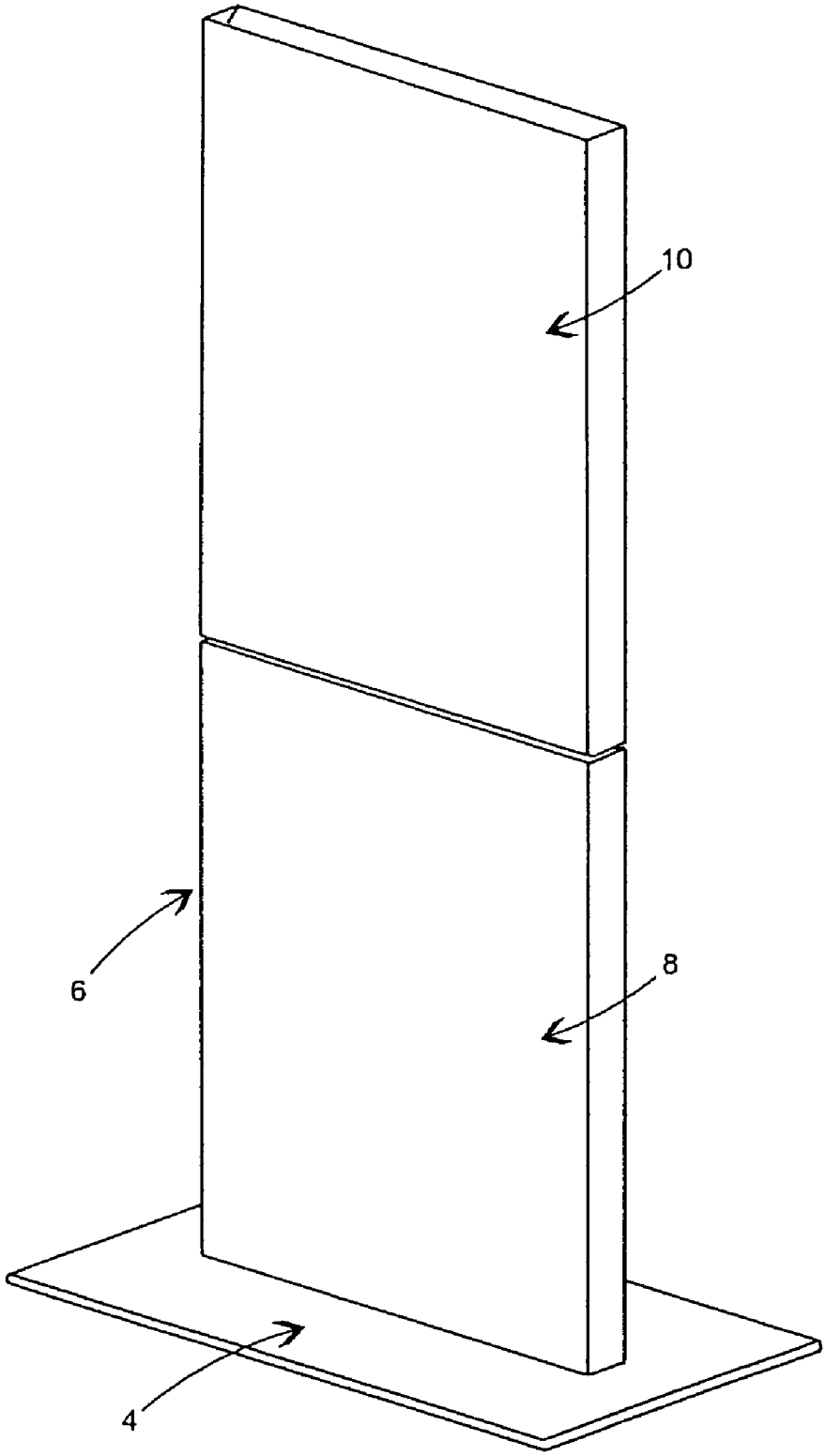
Figure 10:
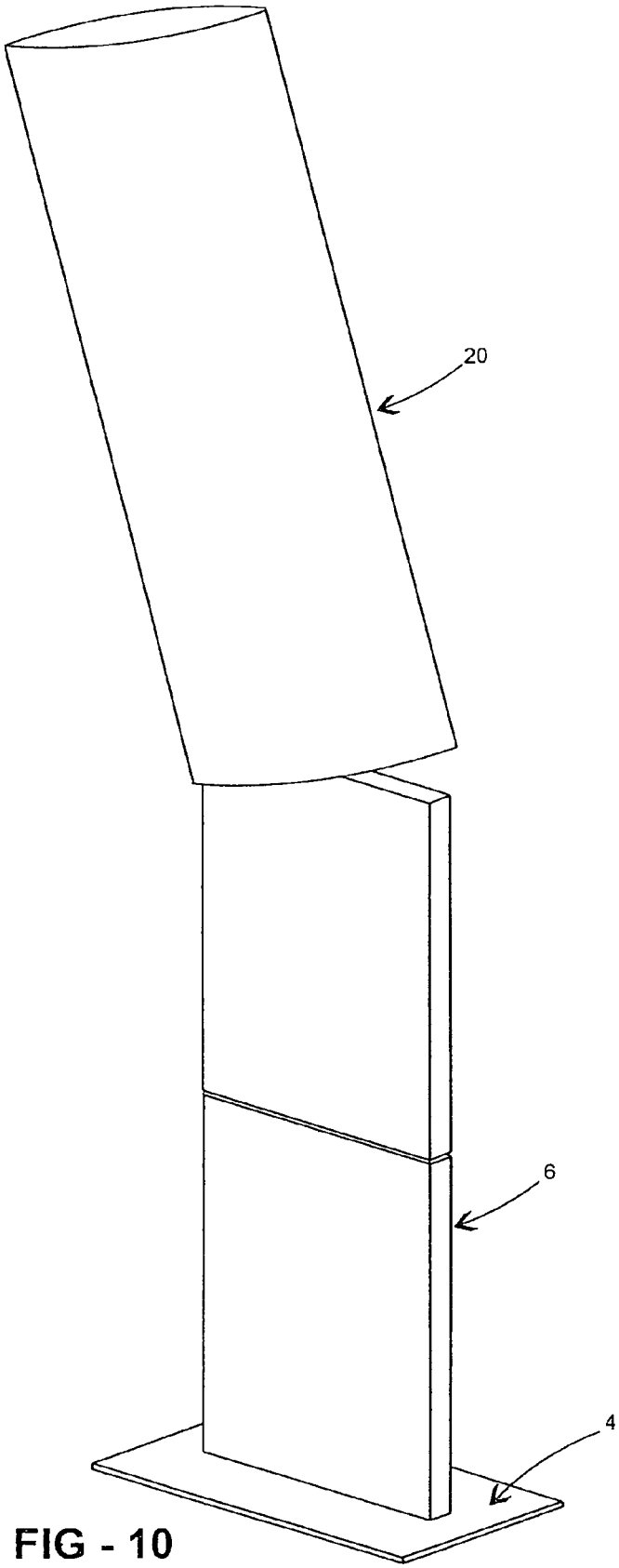
FIGS. 10 and 11 are perspective views of the advertising display system with the display system including a deformable flat sleeve to be placed over the support post.

The advertising display system as shown in FIGS. 8 and 9 can include the support post 6 defined by the collapsible support members 8 and 10 attached to the base to provide a rectangular-type tower as shown in FIG. 9. Excellent stability is achieved as the base is of a weight significantly greater than the support post. Excellent advertising is provided due to the large rectangular surfaces of the support post and the unit is easily transportable as the support post is of a multi-component configuration.

In some applications the advertising display system of the present invention will initially be sold as a base in combination with a support post. The purchaser can use this system initially to provide effective advertising on the surface of the support post. After a certain period of time, the user may wish to replace the advertising with different advertising. Rather than purchase a new system or at least purchase new components for the support post, the user can purchase a collapsible sleeve 20 that is designed to sleeve onto the post, and this provides a cost-effective enhancement where the particular advertising message is easily changed.

In some circumstances, the purchaser of the system may already have the components 8 and 10 for defining the support post 6. In this case, the user can purchase the base 4 and the advertising sleeve 20 and effectively use the components he has previously purchased to provide his support post. This integration of two distinct advertising systems provides a number of distinct advantages and flexibility for the end purchaser.

Further enhancements to the system are shown in FIGS. 12 through 15. In this case, the support post 6, due to its segmented design and bayonet connections 12 and 14 at the sides of the support post, can include horizontally extending shelf surfaces generally shown as 40. These support surfaces include an elongate slot 42 for receiving the bayonet connection and the support shelves are effectively trapped between two collapsible support members 8 and 10. The bayonets 12 and 14 can include releasable lock tabs to lock with the support members 8 and 10 to further secure the shelves.

It is also possible to effectively use these horizontal shelf members in combination with a modified advertising sleeve. In this case, the advertising sleeve would be provided in two distinct segments: a lower segment which covers the support post below the horizontal shelves, and an upper sleeve that is positioned above the horizontal shelves. In this way, the end purchaser has a number of different options for providing display stands of different configurations. Furthermore, it has been found that this particular display stand, due to the use of a flat planar base of a relatively strong and heavy material relative to the remaining portion of the advertising display, provides an excellent support and is not subject to damage. As a person walks around such an advertising display, if he happens to place his foot on the base 4, the display stand remains in its stable condition and there is no damage to the display stand. The probability of a user bumping into or kicking a display stand is reduced as the base extends outwardly and typically is contacted first without damage. The prior art structures as described in the background of the invention may be prone to this type of damage.

Details of a modified arrangement for the base and the mounting brackets are shown in FIGS. 16 through 25.

The modified base 104 is of a molded plastic with a peripheral edge 106 supporting a raised upper surface 112. A pair of mounting portions 108 and 110 are provided in the upper surface with each mounting portion adapted to engage a molded mounting bracket (126, 128). The mounting portions include three recessed ports 114, 116 and 118, which are open to each other beneath the dividing or separating segments 120 and 122. The recessed ports 114, 116 and 118 are partially closed at a lower edge by bottom portions 115, 117 and 119 respectively. The portion of the base directly beneath the separating segments 120 and 122 are open to simplify molding.

The mounting portions 108 and 110 are adapted to receive the injection molded mounting brackets 126 and 128. These mounting brackets include a base portion 130 and a hinged portion 132.

Figure 17:
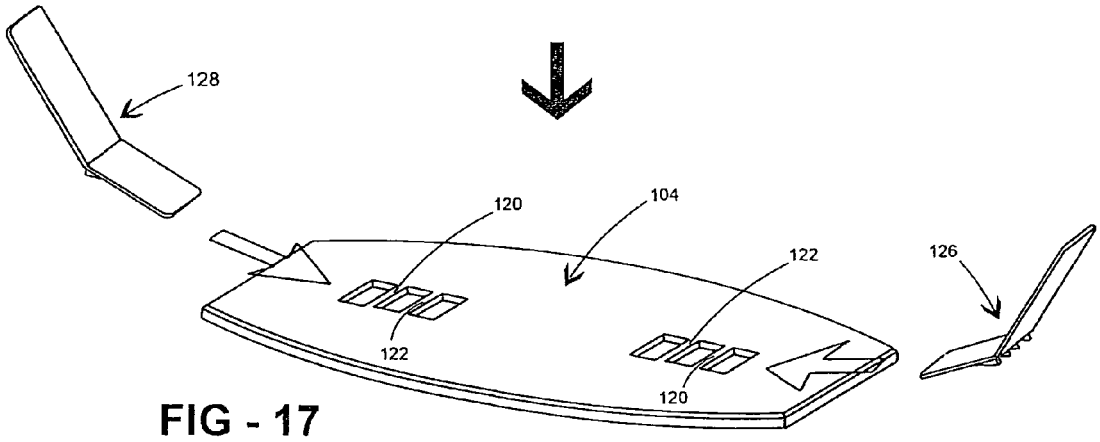
Figure 18:
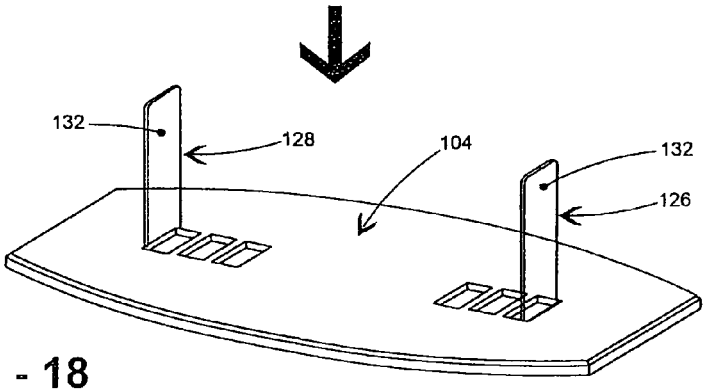

As shown in FIG. 17, the mounting brackets 126 and 128 are inserted into the modified base 104 such that the base portion 130 is received in the base and captured between the separating segments 120 and 122 and the bottom portions 115, 117 and 119. FIG. 18 shows the mounting brackets fully inserted within the mounting portions 108 and 110 of FIG. 18.

Figure 20:
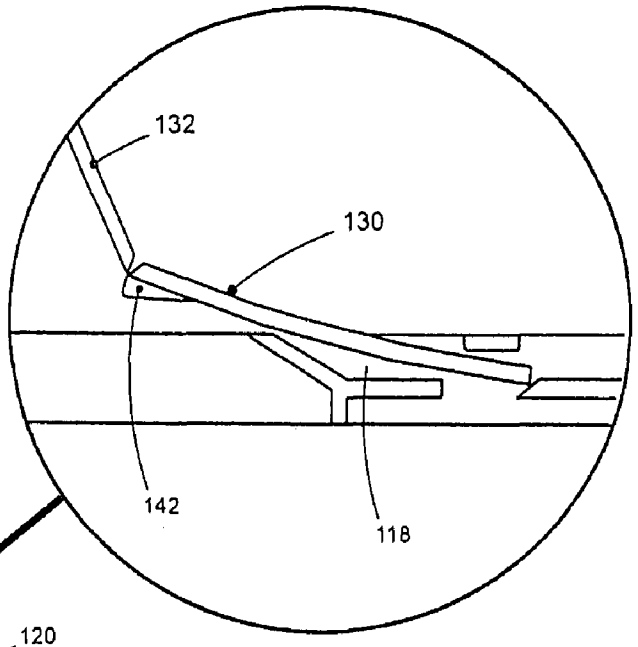
FIGS. 19, 20, 21 and 22 show details of the particular cooperation of a modified mounting bracket and its cooperation with the molded base.
Figure 19:
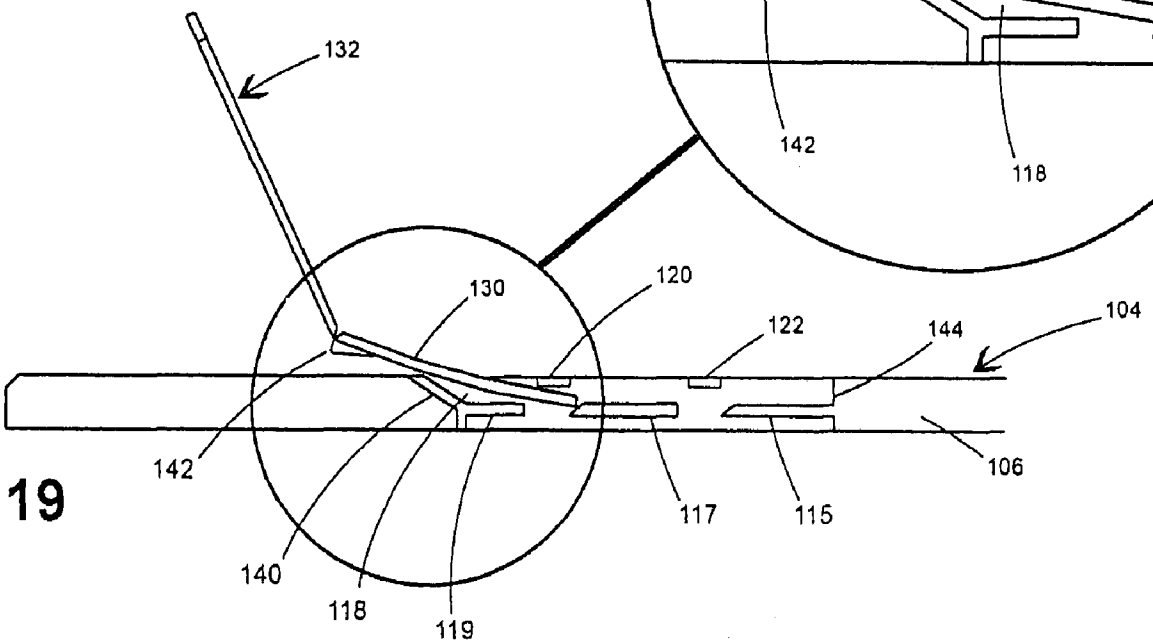
Figure 22:
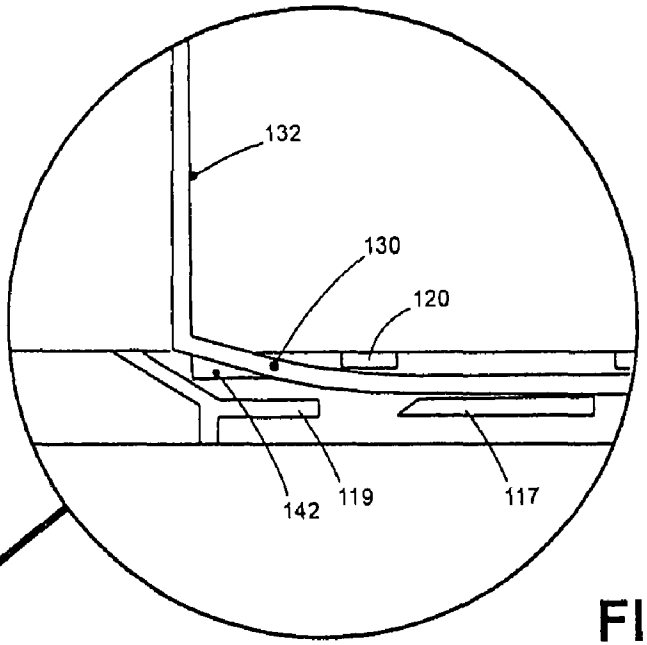
Figure 21:
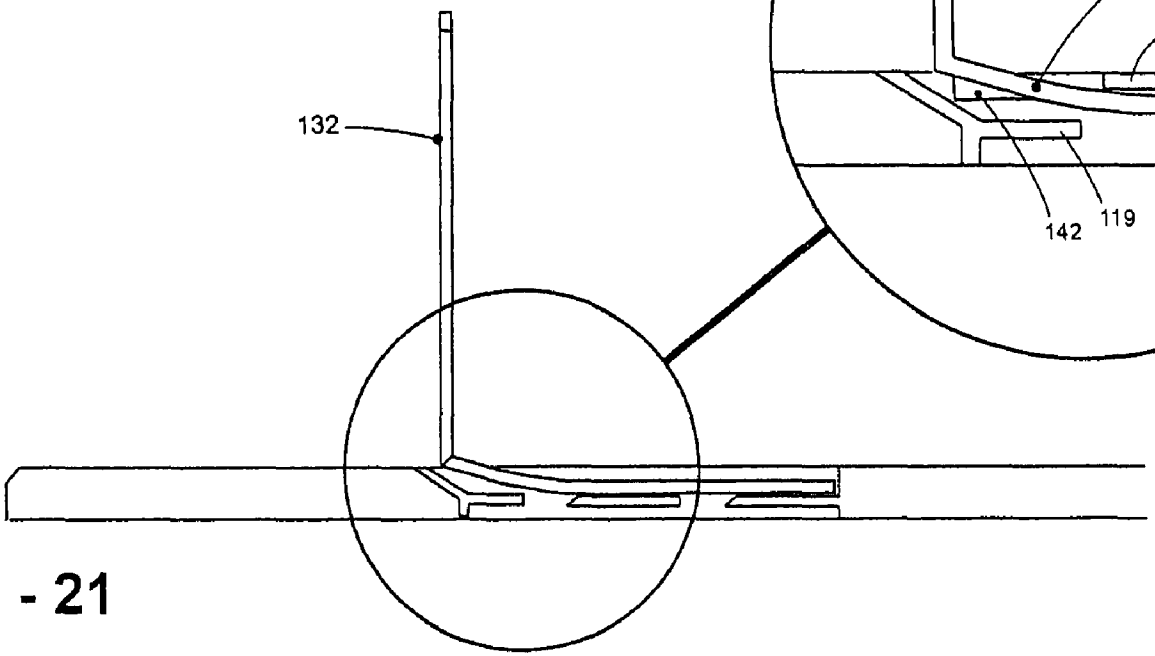

Additional details of the particular cooperation between the mounting brackets 126 and 128 and the mounting portions 108 and 110 are shown in FIGS. 19 through 22. The recessed port 118 includes an angled end wall 140 closing the recessed port at one edge of the base portion 119. The bottom surface of the base portion 130 of the mounting brackets 126 or 128 includes downwardly extending triangular projections 142. These triangular projections on the lower surface of the base portion 130 in combination with the angled end wall 140 act like a cam encouraging the mounting bracket to move to the fully inserted position as shown in FIGS. 21 and 22. As shown in FIGS. 19 and 20, the base portion 130 is inserted into the recessed ports and passes under the separating segments 120 and 122. The base portions 115, 117 and 119 provide bottom support for the base portion 130 and the separating segments 120 and 122 retain the base portion within the recessed ports. Preferably, base portions 117 and 115 include angled walls 145 and 147 to cam the front edge of the base portion onto the base portions 117 and 115.

It can also be appreciated from FIGS. 19 and 21 that the mounting portions 108 and 110 provide a centre floor engaging support within the modified base 104 that cooperates with the downwardly extending peripheral edge 106 to support the base peripherally and centrally. Preferably the base portion 130, when received in a mounting portion, extends to and abuts the end wall 144 of the recessed port 114. This abutment, in combination with the triangular projections 142 engaging the base of the angled wall 140, positively retains the mounting bracket in a predetermined inserted position. It can also be appreciated from FIG. 22 that the triangular projections provide a resilient distortion of the base portion 130 trapping the base portion in the mounting portions 108 or 110. This arrangement provides good retention with wide tolerance variations due to injection molding manufacture and wear. The projections 142 and the angled wall 140 also assist in removal of mounting brackets for transport or other reasons.

Figure 23:
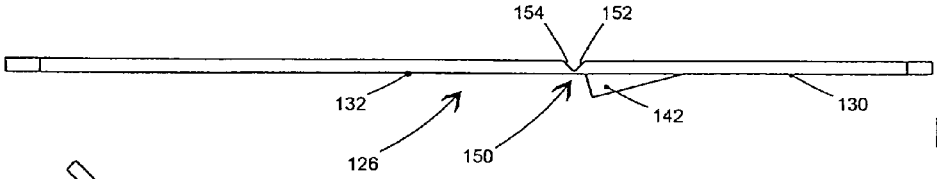
FIGS. 23 through 25 show details of the modified mounting bracket.
Figure 24:
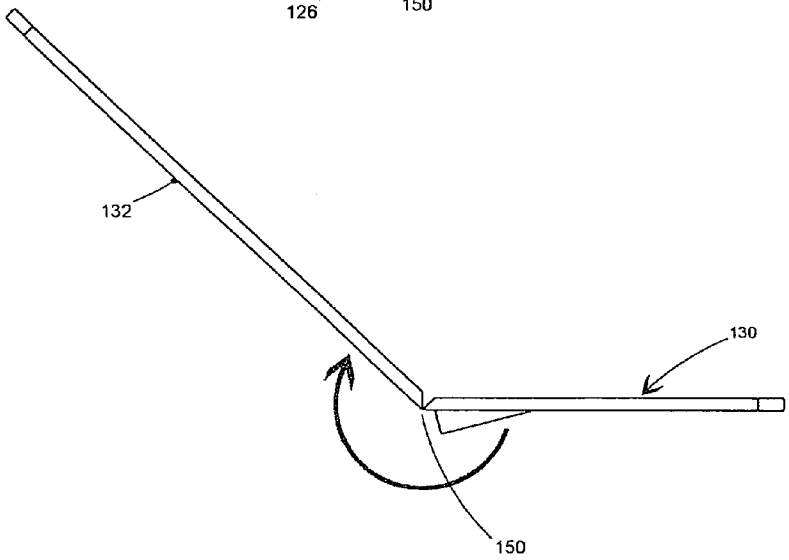
Figure 25:
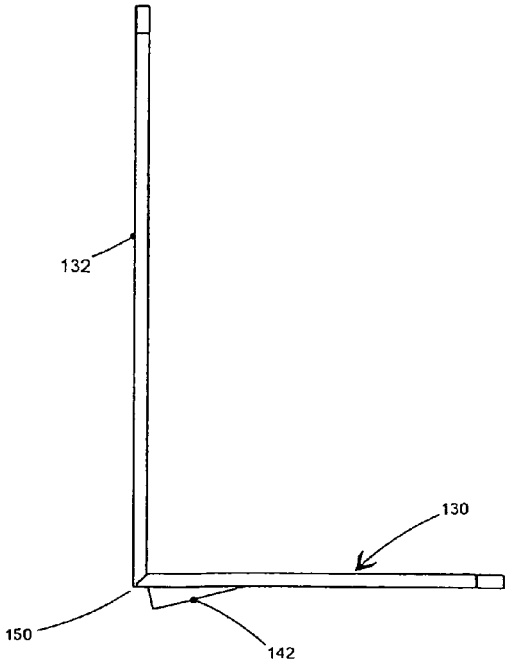

FIGS. 23 through 25 show a side view of the injection molded mounting bracket. The mounting bracket 126 includes a live hinge 150 connecting the angled walls 152 and 154 of the base portion 130 and the hinged portion 132 respectively. The live hinge is positioned in close proximity to the triangular projections 142. The triangular projections 142 are provided at space points across the base portion 130. Preferably, there are three or more of these triangular projections on the base portion 130. The hinged portion 132 can be pivoted about the live hinge 150, as shown in FIG. 24, to assume the perpendicular configuration as shown in FIG. 25. Note that the angled walls 152 and 154 now abut and form a stop mechanism for the live hinge at the perpendicular configuration. The mounting bracket is preferably about 24 cm in length and about 6 cm in width. The base portion is about 9 cm in length.

The plastic material of the mounting brackets is chosen to provide good resiliency and to provide an effective live hinge between the base portion 130 and the hinge portion 132.

The modified base assembly as shown in FIGS. 16 through 25 provides an effective arrangement, and also provides a strong connection between the collapsible support member 8 that forms the bottom portion of the support post 6 of the advertising display shown in the earlier Figures.

One of the advantages of the present system is its ability to be used a number of different times, and to be transported in a flat condition. Over time, there may be damage to the mounting brackets, and the insertable mounting brackets of the modified arrangement allow for replacement if they become damaged or broken. The plastic molded base portion provides excellent stability and is light in weight for easy transport.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. An advertising display comprising:

a base of a generally planar configuration with two spaced mounting brackets securable on an upper surface of said base;

a collapsible support post of a generally rectangular configuration in cross section with one end of said collapsible support in a non collapsed condition including opposed slots that receive and engage upwardly extending portions of said mounting brackets to connect a lower edge of said support post to said upper surface of said base; and advertising media provided on or supported by said support post; and wherein each mounting bracket dudes a secure flange received in said base and a pivotal portion movable from a collapsed position generally parallel to said base to a support post engaging position generally perpendicular to said base.

2. An advertising display as claimed in claim 1 wherein said advertising media is a deformable flat sleeve sized to be applied over said support post and deform to a bowed sidewall configuration in engagement with and supported by said support post; said support post and said flat sleeve cooperating such that said sleeve engages said support post in a manner to maintain said bowed sidewalls while said sleeve is in engagement with said support post.

3. An advertising display as claimed in claim 2 wherein said flat sleeve is biased to maintain a flat configuration and when applied over said support post, moves to said bowed configuration in engagement with said support post.

4. An advertising display as claimed in claim 3 wherein said support post includes at least two rectangular-in-section elongate collapsible support members stacked one above the other with connectors extending therebetween to maintain said collapsible support members in said stacked configuration.

5. An advertising display as claimed in claim 4 wherein said connectors are bayonet-type connectors, and wherein said support members are additionally designed as a component of an advertising display system for forming a segmented wall advertising display.

6. An advertising display as claimed in claim 1 wherein each mounting bracket is made of a plastic material with an integral hinge portion intermediate a length of the mounting bracket.

7. An advertising display as claimed in claim 1 wherein said pivotal portion of each mounting bracket in said collapsed condition overlies and is in direct contact with the upper surface of said base.

8. An advertising display as claimed in claim 7 wherein said mounting brackets are formed as a single piece secured to said base.

9. An advertising display comprising a base of a planar configuration with two spaced mounting brackets received in said base and adapted to extend upwardly from said base and releasably engage a collapsible support post;

said collapsible support post having a rectangular cross section with opposed slots in one end of the support post releasably engaging said two spaced mounting brackets with a lower surface of said support post being positioned at said base; and wherein said base is of a molded plastic and said mounting brackets include a base portion releasably received in mounting ports of said base and extend in the plane of the base.

10. An advertising display as claimed in claim 9 wherein each mounting port in said base includes at least two connected recesses with connected recesses separated by a dividing segment.

11. An advertising display as claimed in claim 10 wherein each mounting port includes three connected recesses and each recess has a base surface that stops adjacent one of said dividing segments.

12. An advertising display as claimed in claim 11 wherein the base portion of each mounting bracket is removably secured in one of said mounting ports and a hinged portion of each mounting bracket is releasably received in said collapsible support post; and wherein said base portion and said hinged portion of each mounting bracket are connected by a live hinge.

13. An advertising display as claimed in claim 12 wherein said base portion of each mounting bracket includes a lower surface thereof adjacent said live hinge a plurality of downwardly extending triangular projections; and wherein each mounting port in said base includes an angled end wall cooperating with said triangular projections to locate said triangular projection adjacent a lower edge of said angled end wall.

* * * * *